US007988009B2

(12) United States Patent
Cavalcante

(10) Patent No.: US 7,988,009 B2
(45) **Date of Patent: *Aug. 2, 2011**

(54) LITTER BIN WITH PIVOTAL LID AND AUTOMATIC LATCHING MECHANISM

(75) Inventor: Mauricio D. Cavalcante, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 855 days.

This patent is subject to a terminal disclaimer.

(21) Appl. No.: 11/059,152

(22) Filed: Feb. 15, 2005

(65) Prior Publication Data

US 2006/0180588 A1 Aug. 17, 2006

(51) Int. Cl.
*B65D 45/16* (2006.01)
*E05C 3/02* (2006.01)

(52) U.S. Cl. ..... 220/324; 220/810; 220/908; 292/230; 292/304

(58) Field of Classification Search ..... 220/908, 220/324, 263, 810; 16/231, 232; 292/194, 292/230, 238, 304, 231, DIG. 11
See application file for complete search history.

(56) References Cited

U.S. PATENT DOCUMENTS

| | | | | |
|---|---|---|---|---|
| 4,155,584 | A * | 5/1979 | Pracchia | 294/68.26 |
| 4,182,530 | A | 1/1980 | Hodge | |
| RE30,890 | E | 3/1982 | Hodge | |
| 5,011,360 | A | 4/1991 | Abram et al. | |
| 5,015,021 | A | 5/1991 | Wyson et al. | |
| 5,042,856 | A | 8/1991 | Goodman | |
| 5,085,341 | A | 2/1992 | Hodge | |
| 5,094,358 | A | 3/1992 | Serio, Sr. | |
| 5,094,487 | A | 3/1992 | Drewry | |
| 5,105,967 | A | 4/1992 | Horpestad | |
| 5,118,000 | A | 6/1992 | Howell et al. | |
| 5,135,129 | A | 8/1992 | Joly | |
| 5,415,314 | A * | 5/1995 | McCollum | 220/315 |
| 5,474,341 | A | 12/1995 | Putman et al. | |
| 5,599,050 | A | 2/1997 | Tinsley | |
| 5,662,364 | A | 9/1997 | Reeb et al. | |
| 5,683,126 | A * | 11/1997 | De Vivo et al. | 292/230 |
| 5,738,395 | A | 4/1998 | Probst | |
| 5,772,061 | A | 6/1998 | Lowe | |
| 5,772,264 | A | 6/1998 | Bettenhausen | |
| 5,997,052 | A | 12/1999 | Reeb | |
| 6,290,093 | B1 | 9/2001 | Obriot et al. | |
| 6,666,485 | B1 | 12/2003 | Moret | |
| 6,808,080 | B2 | 10/2004 | Spiers et al. | |
| 7,540,393 | B2 * | 6/2009 | Wong | 220/324 |
| 2003/0168466 | A1 * | 9/2003 | Spiers et al. | 220/835 |

* cited by examiner

*Primary Examiner* — Robin Hylton
(74) *Attorney, Agent, or Firm* — Carlson, Gaskey & Olds

(57) ABSTRACT

A litter bin includes a lid hingeably connected to a container. Opposite the hinge, a latch selectively secures the lid to the container. The latch includes a pivotably mounted latch member. The latch member includes a catch portion that moves between a locked position and an unlocked position upon pivoting of the latch member. A weight is pivotably connected to the latch member at a point offset from the pivot axis of the latch member, thereby further retaining the catch portion of the latch member in the locked position. The litter bin must be tilted past a nonzero tilt threshold before the latch member pivots the catch portion from the locked position to the unlocked position.

18 Claims, 8 Drawing Sheets

LITTER BIN WITH PIVOTAL LID AND AUTOMATIC LATCHING MECHANISM

BACKGROUND OF THE INVENTION

This invention relates to litter bins and more particularly to a litter bin having a gravity activated lock for a lid.

Litter bins are often used in outdoor environments and include a container defining an opening over which a lid is removably or hingeably attached. Side openings in the lid and/or container permit people to throw away litter into the container. The lid must be removed to empty the litter bin. Some litter bins include manually actuated latches to secure the lid to the container. This makes it more difficult to remove the lid and empty the litter bin. In particular, this makes it difficult for automated handling equipment to lift and empty the contents of the litter bins. Also, this does not prevent an unauthorized users from lifting the lid.

SUMMARY OF THE INVENTION

A litter bin according to the present invention includes a lid hingeably connected to a container. Opposite the hinge, a latch normally keeps the lid latched to the container. The latch is gravity-actuated, such that the lid is released when the litter bin is tilted sufficiently, thus making it easy to open the lid and empty the litter bin while preventing unauthorized access.

The latch includes a latch member having a catch portion that moves between a locked position and an unlocked position upon pivoting of the latch member about a pivot axis. The latch further includes a pendulous weight pivotably connected to the latch member at a pivot axis offset from the pivot axis of the latch member. Because the pivot axis of the pendulous weight is offset from the pivot axis of the latch member, slight tilting or rocking of the litter bin does not release the latch. Pivoting of the latch member does not occur until the litter bin is tilted past the point where the pivot axis of the latch member is vertically aligned with the pivot axis of the pendulous weight. As the litter bin continues to be tilted, the catch portion is pivoted about its pivot axis from the locked position to the unlocked position.

With the gravity-actuated latch, the lid is released automatically simply by tilting the litter bin while emptying it. Therefore, automated handling equipment need only lift and tilt the litter bin to empty it, without having to actuate the latch separately. The offset pendulous weight does not unlock the latch if the litter bin is only partly tilted or only rocked. The offsetting of the pivot axis of the pendulous weight from the pivot axis of the latch ensures that the latch does not unlock until the litter bin is tilted sufficiently, such as when it is being emptied by an automated handling device.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
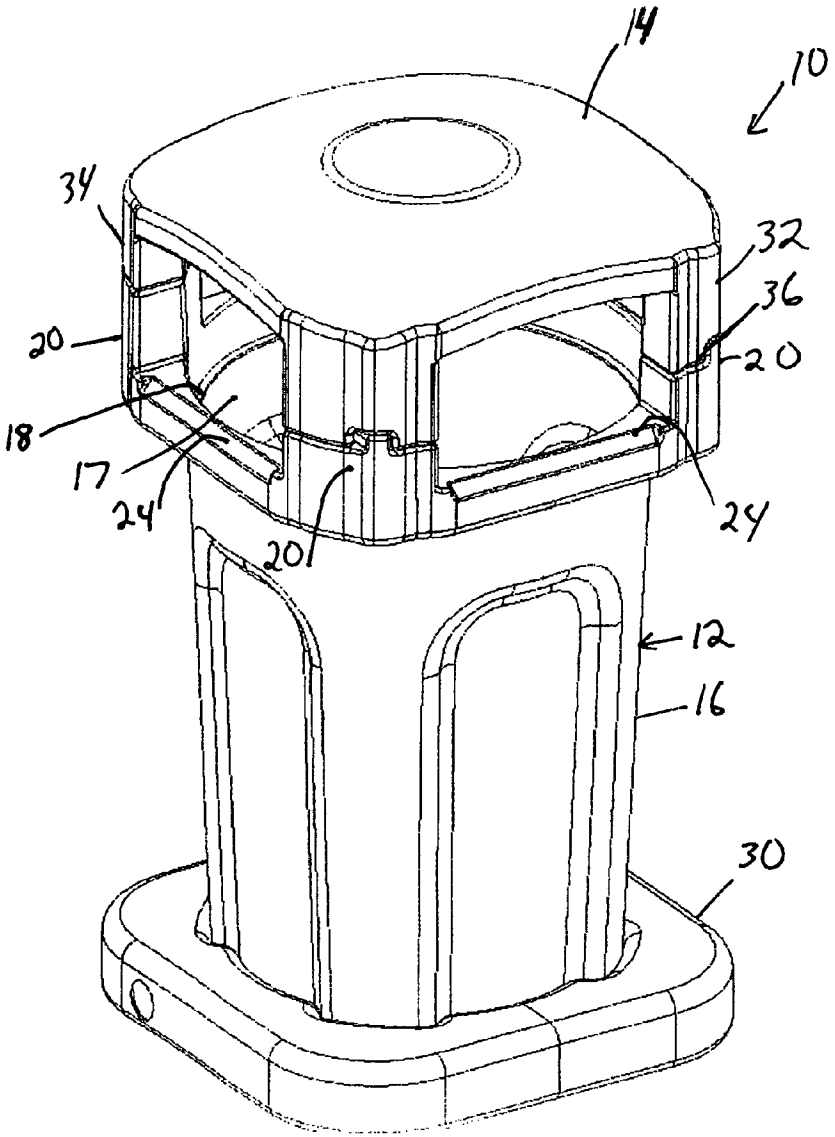
FIG. 1 is a perspective view of a litter bin according to the present invention.

A litter bin 10 is shown in FIG. 1 including a body or container 12 with a lid 14 attached thereto. The container 12 includes a roughly cylindrical wall 16 defining an interior 17 and an opening 18 at the upper end of the wall 16 leading to the interior 17. A plurality of columns 20 extend upwardly from the wall 16, thereby defining openings 24. A base 30 is mounted to a lower end of the wall 16. While the embodiment show herein is directed to a litter bin 10, it is understood that the concepts described and shown herein could also apply to various container/lid combinations.

The lid 14 has a rearward end 32 opposite a forward end 34 that extends downwardly and mates with a column 20 extending upwardly from the container 12. The rearward end 32 of the lid 14 is connected to another column 20 of the container 12 via a hinge 36.

Figure 2:
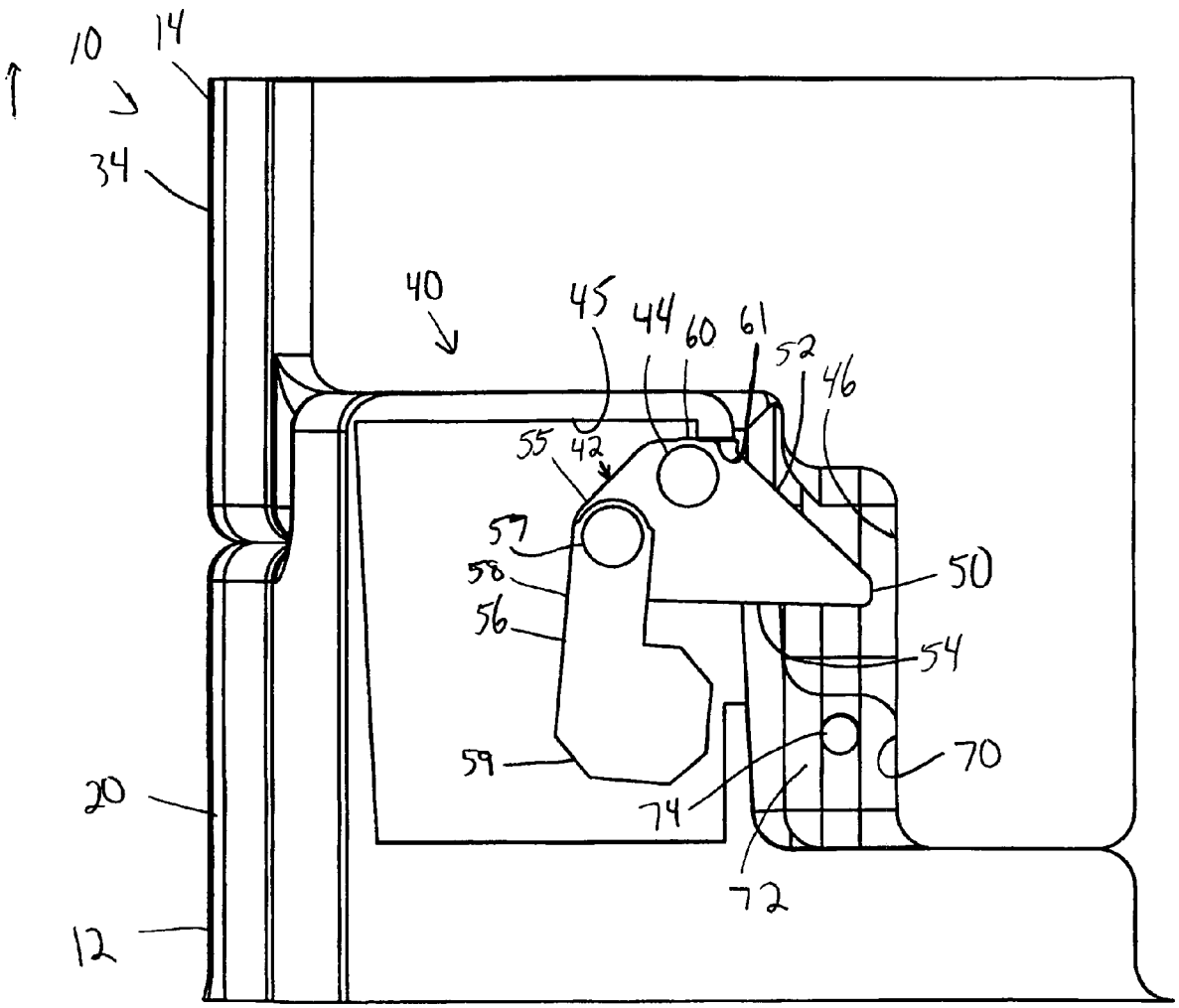
FIG. 2 is an enlarged view, partially broken away, of the latch area of the litter bin of FIG. 1 with the latch in the latched position

FIG. 2 is a sectional view through the forward end 34 of the lid 14 and the column 20 therebelow. As shown, the forward end 34 of the lid 14 is releasably secured to the column 20 of the container 12 via a latch system 40, which is shown in the latched position in FIG. 2. The latch system 40 generally includes a latch member 42 having an integral pivot pin 44 pivotably supported inside a recess 45 in the column 20 of the container 12. The latch further includes a latch receiver 46 at a lower end of the forward end 34 of the lid 14.

The latch member 42 includes a catch portion 50 extending outwardly away from the pivot pin 44. The catch portion 50 includes an inclined leading upper edge 52 adjacent a horizontal shoulder 54. The latch member 42 further includes a tail portion 55 extending rearwardly from the pivot pin 44.

A pendulous weight 56 is pivotably connected to the tail portion 55 via a pivot pin 57 having a pivot axis offset rearwardly and downwardly from the pivot axis of the pivot pin 44 of the latch member 42. The weight 56 is connected to the litter bin only by the latch member 42. The weight 56 includes an arm 58 extending downward from the pivot pin 57 to a mass 59. The mass 59 is offset from the axis of the arm in the direction toward the latch receiver 46. In the latched position, gravity pulls the pendulous weight 56 downward at its pivot pin 57. Because the pivot pin 57 of the pendulous weight 56 is offset rearwardly from the pivot pin 44 of the latch member 42, this urges the latch member 42 toward the latched position and urges the upper surface 60 of the latch member 42 against an upper stop surface 61 of the column 20.

The latch receiver 46 includes a recess 70 between a pair of spaced apart arms 72 (one shown) extending downwardly from the forward end 34 of the lid 14. A stop pin 74 is mounted between the arms 72.

The shape, size, thickness and materials of the various portions of the latch member 42, including the pendulous weight 56, can be varied to provide the same functions described herein in a different configuration. These variations would be considered to be part of the present invention.

In the latched position, the latch system 40 prevents opening of the lid 14. When the catch portion 50 is in the latched position and the lid 14 is lifted, the stop pin 74 contacts the shoulder 54 of the catch portion 50. Movement of the catch portion 50 (and therefore the stop pin 74) is prevented by the latch member 42 contacting the upper stop surface 61 of the column 20.

Figure 3:
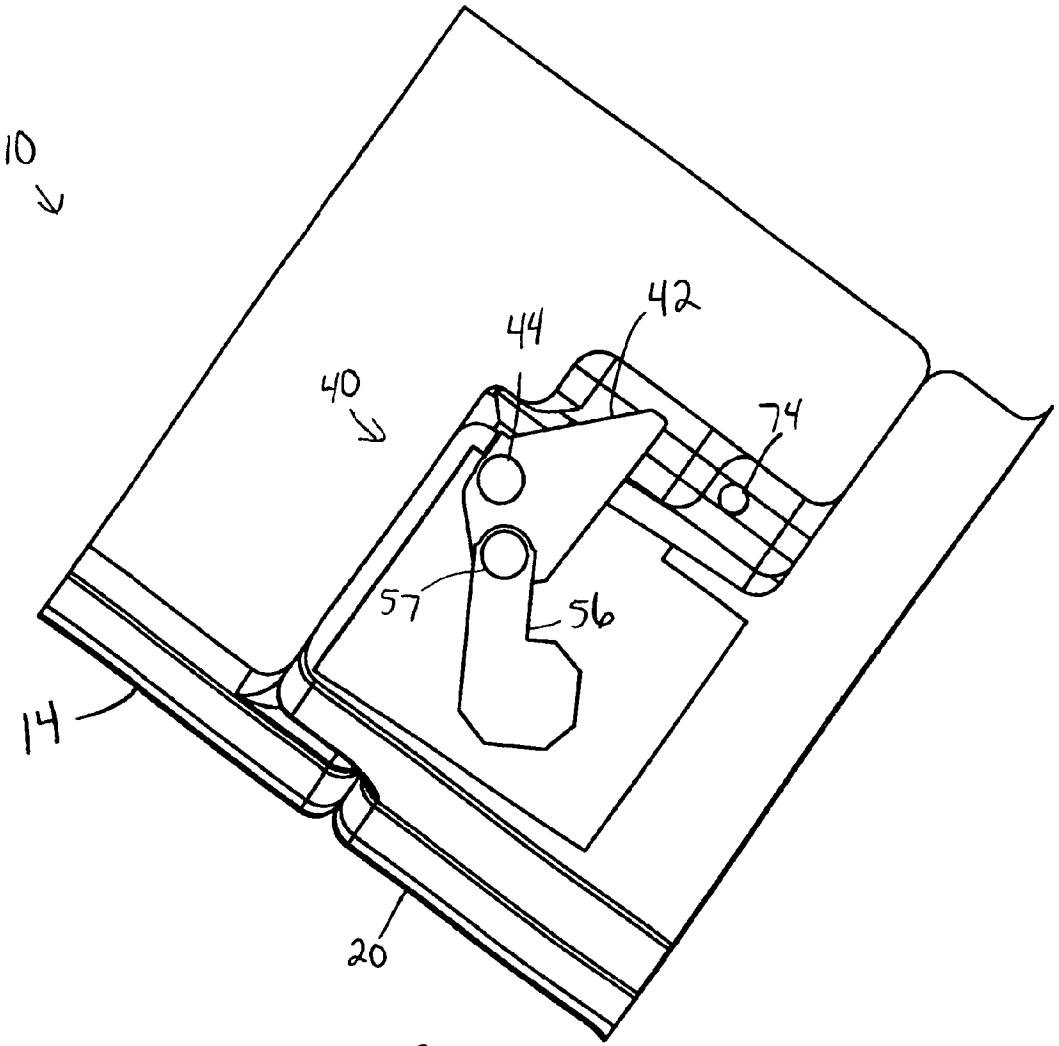
FIG. 3 is view similar to that of FIG. 2, with the litter bin rotated to a tilt threshold angle.
Figure 4:
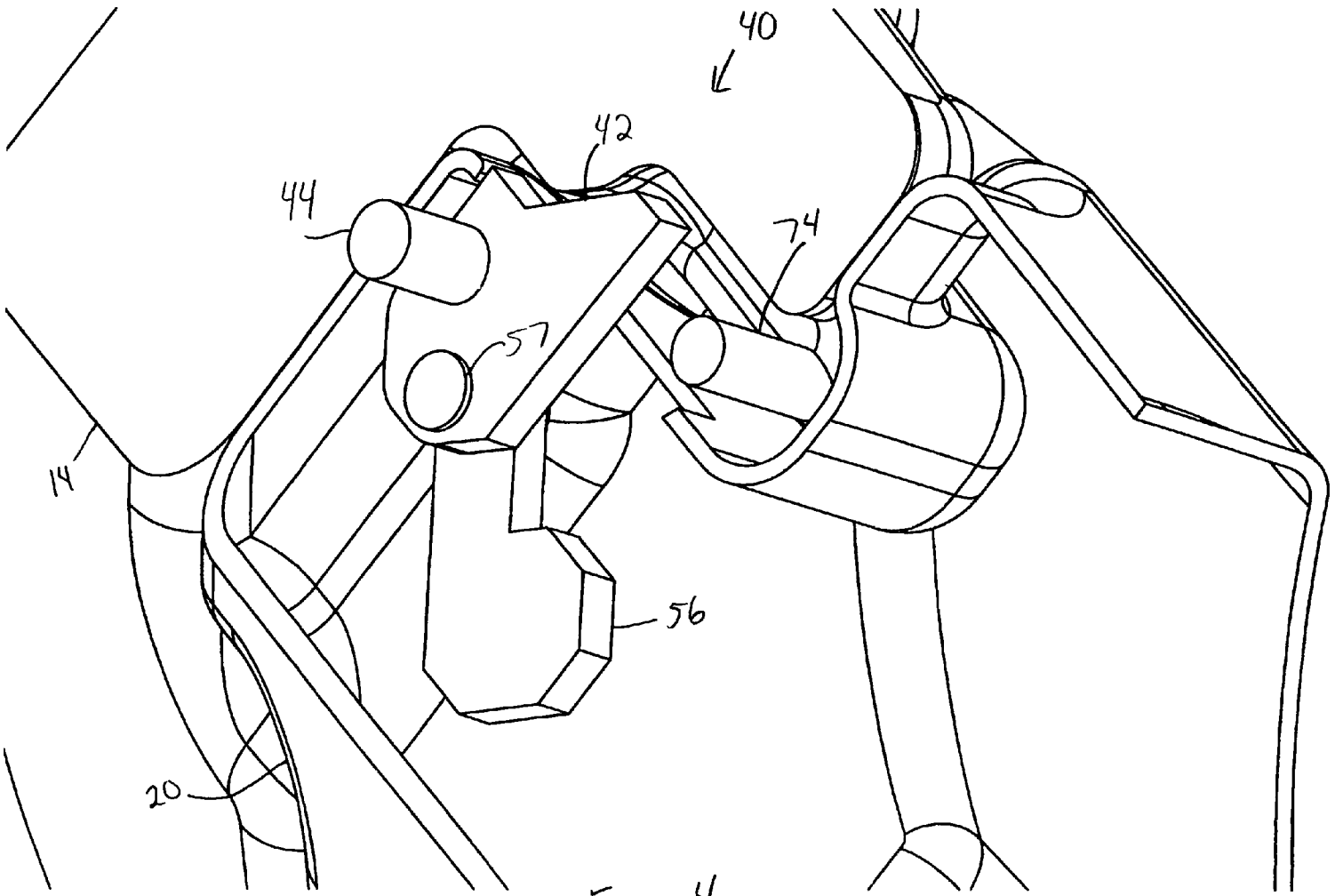
FIG. 4 is perspective view of the latch of FIG. 3.

FIGS. 3 and 4 show the latch system 40 of FIG. 2 rotated approximately 45 degrees, which in the specific configuration shown and described for purposes of illustration, is the nonzero tilt angle threshold. When rotated to this threshold angle, the pivot pin 44 of the latch member 42 becomes vertically aligned with the pivot pin 57 of the pendulous weight 56 in equilibrium, such that the pendulous weight 56 no longer rotatably urges the latch member 42 toward the latched position (counterclockwise in the drawing). Even in this orientation, the latch member 42 still prevents the lid 14 from being opened. The latch member 42 still blocks the movement of the stop pin 74 upward in a first rotational direction.

Figure 5:
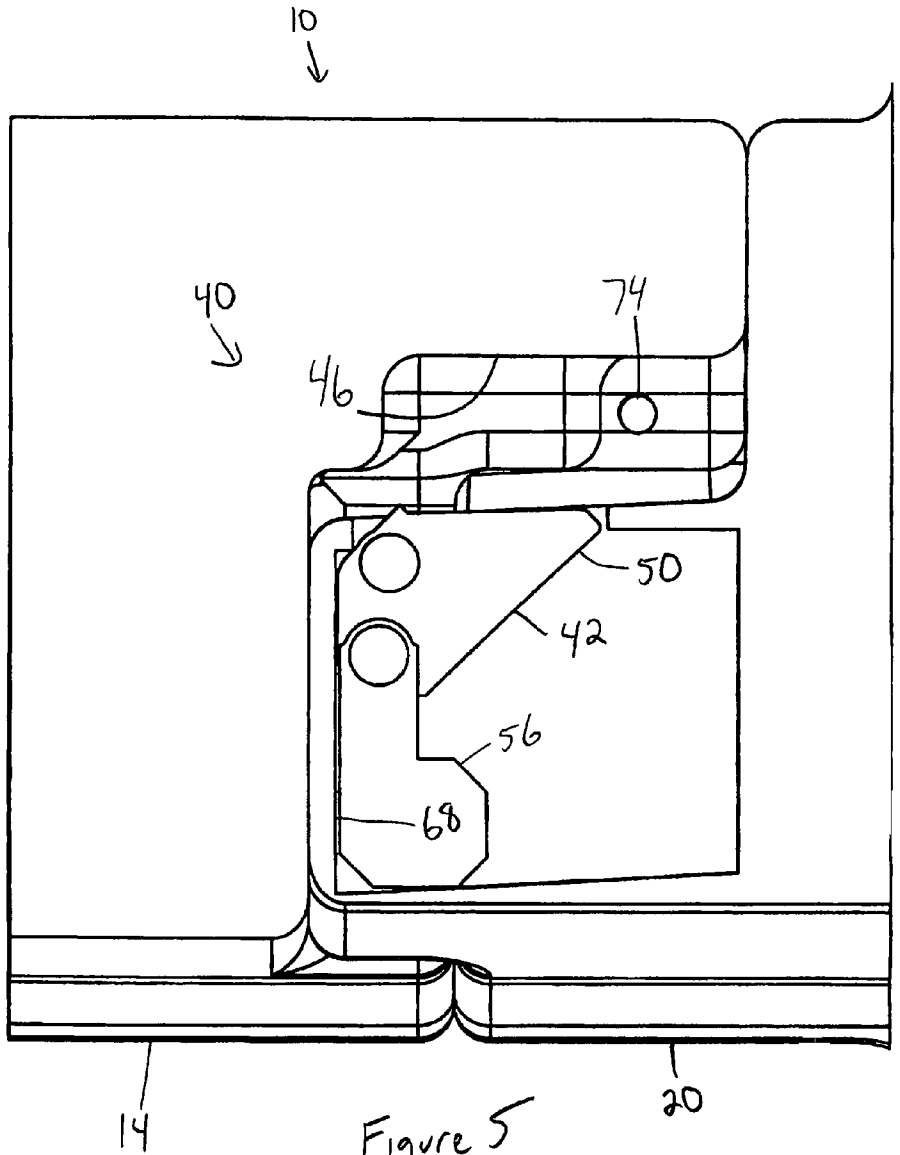
FIG. 5 shows the latch in a view similar to that of FIG. 2, with the litter bin rotated to a horizontal position and with the latch in the unlatched position.
Figure 6:
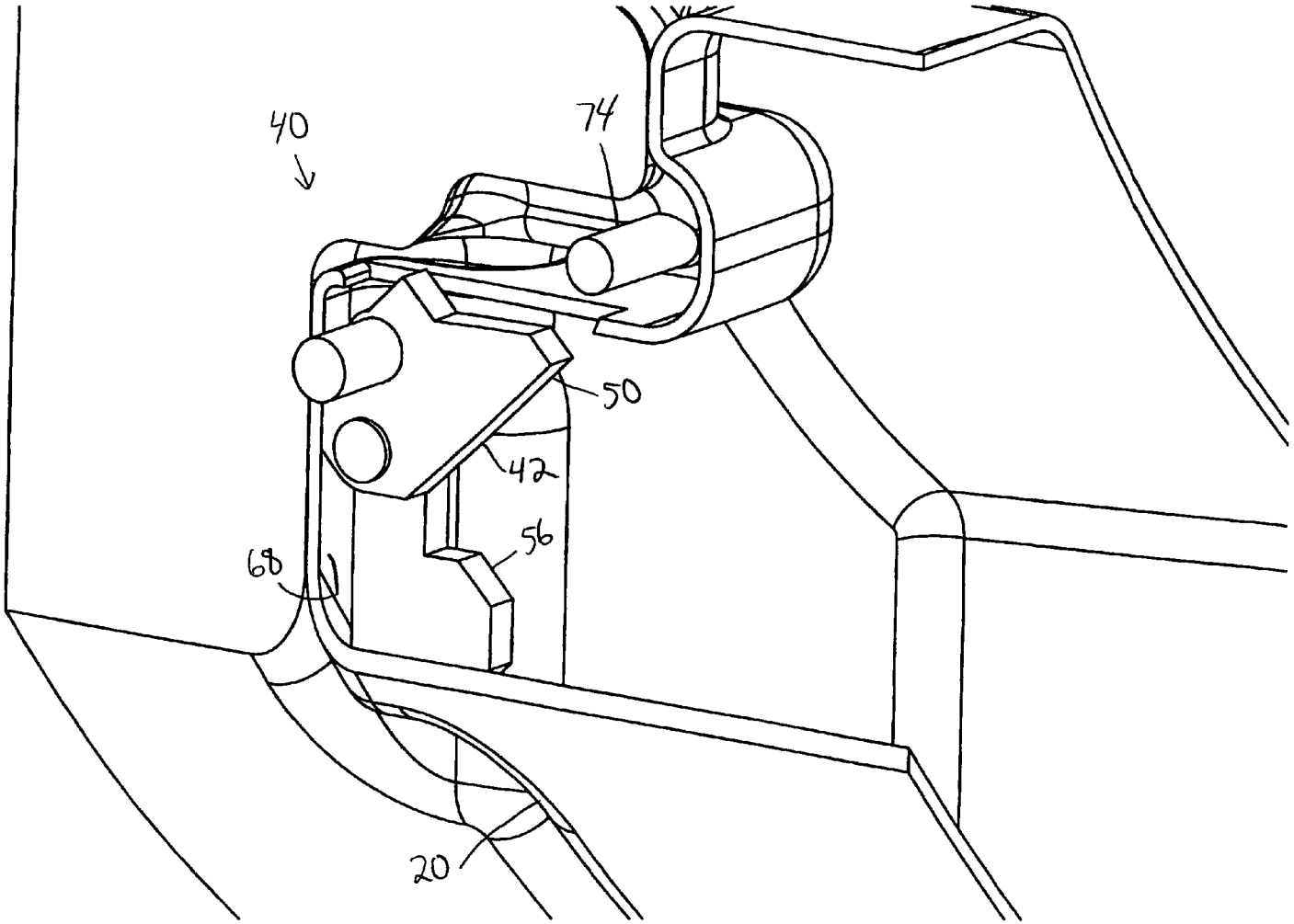
FIG. 6 is perspective view of the latch of FIG. 5.
Figure 7:
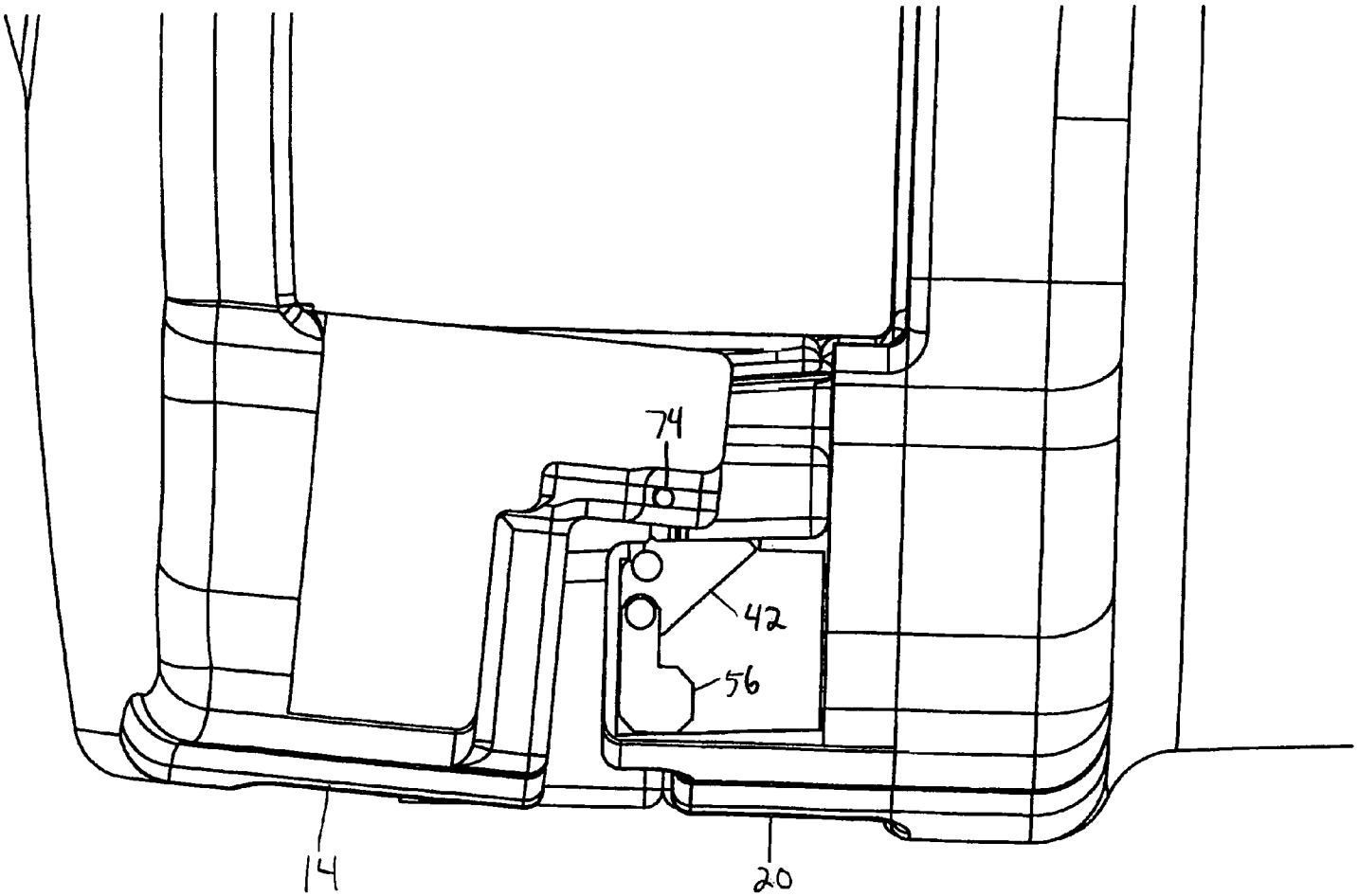
FIG. 7 is a side view of the litter bin (with the latch area partially broken away) with the latch released.
Figure 8:
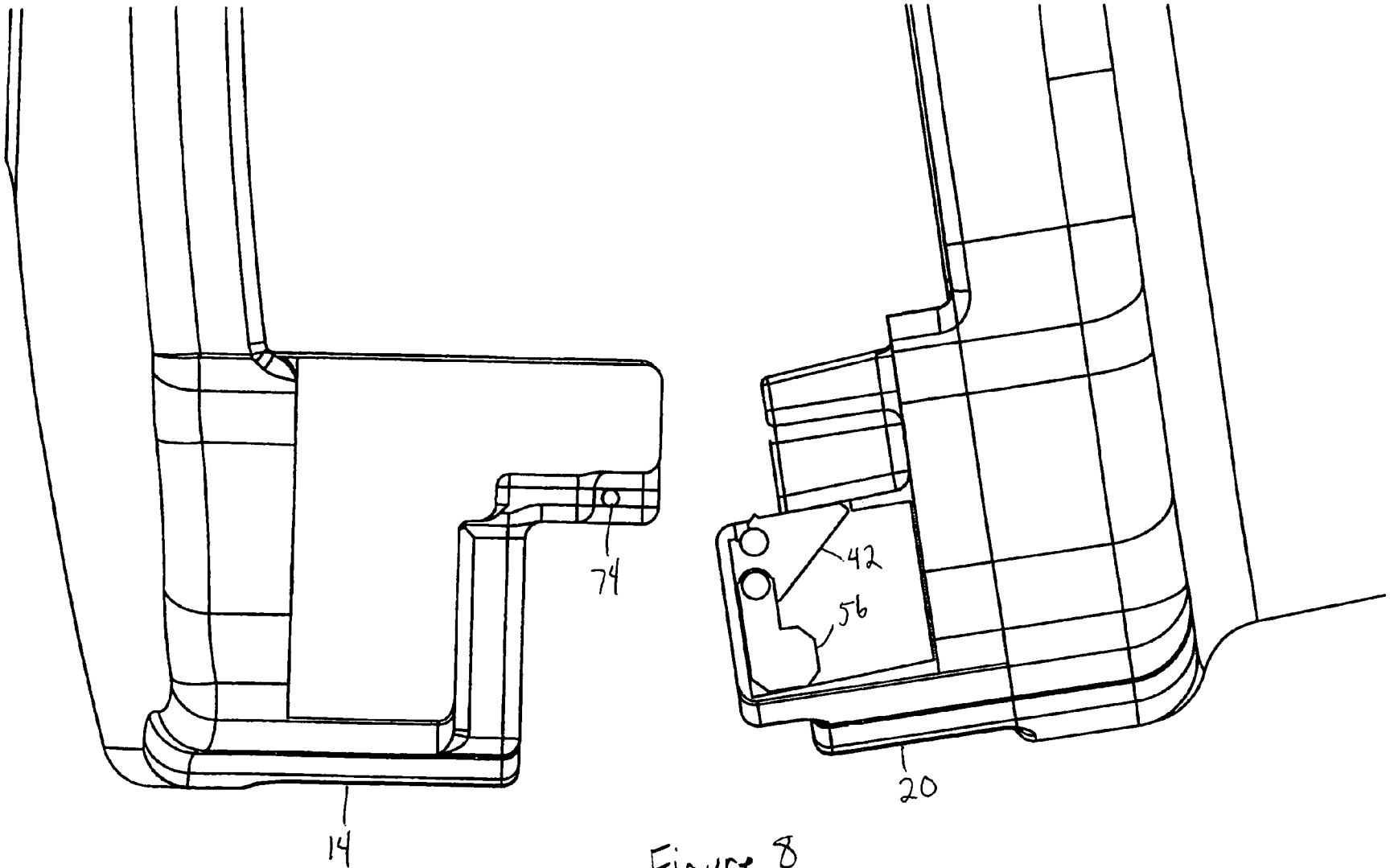
FIG. 8 shows the litter bin of FIG. 7 rotated past horizontal, such that the lid begins to swing open during emptying.

As the litter bin 10 is further rotated past the tilt angle threshold, the pendulous weight 56 pulls the latch member 42 rotatably away from the latch position toward the unlatched position (clockwise in the drawings). In the example illustrated, when the litter bin 10 is rotated to the horizontal position as shown in FIGS. 5 and 6, the catch portion 50 of the latch member 42 is moved to an unlatched position. The catch portion 50 shown is completely disengaged from the latch receiver 46 and the pendulous weight 56 and the latch member 42 abut an upper wall 68 of the column 20. The catch portion 50 of the latch member 42 no longer blocks the movement of the stop pin 74 and the lid 14 can be opened freely, as shown in FIGS. 7 and 8.

Because the latch system 40 is gravity-actuated, the lid 14 is released automatically upon tilting the litter bin 10 past the tilt angle threshold while emptying it. Therefore, automated handling equipment need only lift and tilt the litter bin 10 to empty it, without having to actuate the latch system 40 separately. The offset pendulous weight 56 ensures that the latch system 40 does not release the lid 14 until the threshold title angle is exceeded, so that minor tilting or rocking does not release the latch system 40.

The latch system 40 permits the lid 14 to be closed again and latched automatically. Referring to FIG. 2, when the lid 14 is moved downwardly, the stop pin 74 contacts the inclined leading upper edge 52 of the catch portion 50, thereby rotating the latch member 42 away. When the stop pin 74 passes below the catch portion 50, the pendulous weight 56 urges the latch member 42 back toward the latch receiver 46, moving the catch portion 50 back to the latched position shown.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are different designs of containers that would benefit from the present invention.

What is claimed is:

1. A litter bin comprising:

a container having a wall defining an interior and an opening to the interior;

a lid for selectively covering the opening; and a latch selectively connecting the lid to the container, the latch including a latch member pivotable relative to the bin about a first axis between a first position and a second position, the latch member including a catch portion that impedes movement of the lid away from the opening when the latch member is in the first position and that permits movement of the lid away from the opening when the latch member in the second position, the latch further including a weighted member pivotally attached to the latch member at a second axis offset from the first axis, such that the weighted member is connected to the litter bin only via the latch member, the latch member movable between the first position and the second position by tilting the litter bin such that gravity acts upon the weighted member to pivot the latch member, wherein the second axis is pivotable about the first axis.

2. The litter bin of claim 1 wherein the latch member is in the first position when the container is in a vertical orientation and stays in the first position when the container is tilted up to a nonzero tilt angle threshold, the latch member beginning to move out of the first position when the container is tilted past the tilt angle threshold.

3. The litter bin of claim 2 wherein the latch member is pivotable about a first axis, the weighted member pivotable relative to the latch member about a second axis offset from the first axis.

4. The litter bin of claim 3 wherein the tilt angle threshold is when the first axis is substantially vertically aligned with the second axis.

5. The litter bin of claim 1 wherein the catch portion is received in a latch receiver when the latch member is in the first position, the latch member mounted on one of the container and the lid, the latch receiver mounted on the other of the container and the lid.

6. A litter bin comprising:

a container having a wall defining an upper opening to an interior of the container;

a lid for selectively covering the opening;

a latch selectively connecting the lid to the container over the opening, the latch including a weighted member pivotally attached to a latch member having a catch portion movable between a first position and a second position, wherein the latch member is pivotable about a first axis, the catch portion impeding movement of the lid away from the container when the catch portion is in the first position and permitting movement of the lid away from the container when the catch portion is in the second position, the catch portion in the first position and lower than the first axis when the container is in an upright position, the catch portion staying in the first position when the container is tilted up to a nonzero tilt angle threshold, the catch portion moving toward the second position when the container is tilted past the tilt angle threshold, wherein the weighted member is pivotally attached above the catch portion, when the latch member is in the first position.

7. The litter bin of claim 6 wherein the latch member is pivotable about a first axis, the latch further including the weighted member bearing upon the latch member at a point offset from the first axis.

8. The litter bin of claim 7 wherein the weighted member is pivotably connected to the latch member at the point offset from the first axis.

9. The litter bin of claim 8 wherein the first axis is substantially vertically aligned with the point when the container is at the tilt angle threshold.

10. A container and lid assembly comprising:

a container having a wall defining an upper opening to an interior of the container, the container including a first column portion extending upwardly from an upper most portion of the wall;

a lid for selectively covering the upper opening, the lid including a second column portion extending downwardly toward the first column portion of the container, the first column portion and the second column portion spacing the lid away from the upper most portion of the wall to leave an opening through which items can be inserted into the upper opening of the container;

a latch member and a latch receiver, the latch member mounted pivotably about a first pivot axis to one of the first column portion and the second column portion, the latch receiver being mounted in the other of the first column portion and the second column portion, the latch member having a catch portion movable between a locked position and an unlocked position upon pivoting of the latch member, the latch further including a weighted member pivotally attached to the latch member about a second axis offset from the first axis, the weighted member pivotable relative to the latch member, the weighted member affecting movement of the catch portion between the locked position and the unlocked position.

11. The container of claim 10 wherein the catch portion is in the locked position when the container and lid are in an upright position, the catch portion staying in the locked position when the container and lid are tilted up to a nonzero tilt angle threshold, the catch portion moving toward the unlocked position when the container is tilted past the tilt angle threshold.

12. The container of claim 10 wherein the weighted member is pivotably connected to the latch member at the second axis.

13. The container of claim 10 wherein the catch portion pivots in a first direction from the locked position to the unlocked position, the weighted member urges the catch portion opposite the first direction when the container and lid are in the upright position.

14. The litter bin of claim 1 wherein the weighted member is pivotable about a first radius relative to the latch and a second radius relative to the pivot axis of the latch member different from the first radius.

15. The litter bin of claim 5 wherein the weighted member is pivotally attached above the catch portion, when the latch member is in the first position.

16. A litter bin comprising:

a container having a wall defining an interior and an opening to the interior;

a lid for selectively covering the opening; and a latch selectively connecting the lid to the container, the latch including a latch member pivotable about a first axis between a first position and a second position, the latch member pivotable about the first axis between a latched position to an unlatched position, the latch member in the latched position blocking a stop member that would contact the latch member and urge the latch member in a first rotational direction, the latch member movable from the latched position to the unlatched position in a second rotational direction opposite the first rotational position, the latch further including a weighted member pivotally attached to the latch member at a second axis offset from the first axis, the latch member movable between the first position and the second position by tilting the litter bin such that gravity acts upon the weighted member to pivot the latch member, wherein the second axis is pivotable about the first axis.

17. The litter bin of claim 16 wherein the latch member is in the first position when the container is in a vertical orientation and stays in the first position when the container is tilted up to a nonzero tilt angle threshold, the latch member beginning to move out of the first position when the container is tilted past the tilt angle threshold.

18. The litter bin of claim 1 wherein the weighted member changes the center of gravity of the latch member from the first position to the second position.

* * * * *